US005119625A

United States Patent [19]

Glowacki

[11] Patent Number: 5,119,625

[45] Date of Patent: Jun. 9, 1992

[54] BLOW-OFF DEVICE FOR A BYPASS GAS TURBINE ENGINE

[75] Inventor: Pierre A. Glowacki, Fontaine le Port, France

[73] Assignee: Societe Nationale d'Etude et de Construction de Motors d'Aviation "S.N.E.M.C.A.", Paris, France

[21] Appl. No.: 545,643

[22] Filed: Jun. 29, 1990

[30] Foreign Application Priority Data

Jul. 5, 1989 [FR] France ..... 89 09027

[51] Int. Cl.[5] ..... F02C 7/00; F02K 3/06

[52] U.S. Cl. ..... 60/226.3; 60/39.29

[58] Field of Search ..... 60/39.29, 39.07, 226.2, 60/226.3, 226.1; 137/15.1, 15.2

[56] References Cited

U.S. PATENT DOCUMENTS 3,638,428 2/1972 Shipley et al. ..... 60/39.29

FOREIGN PATENT DOCUMENTS 2260697 9/1975 France .
2315007 1/1977 France .
2003988 3/1979 United Kingdom .

*Primary Examiner*—Richard A. Bertsch
*Assistant Examiner*—Howard R. Richman
*Attorney, Agent, or Firm*—Oblon, Spivak, McClelland, Maier & Neustadt

[57] ABSTRACT

A blow-off device for a gas turbine bypass engine having a primary air flow path separated from an outer secondary air flow path by a partition includes a plurality of discharge passages passing through the partition from the primary air flow path to the secondary air flow path, each of the discharge passages having a first hinged flap in the outer wall of the primary air flow path, a second hinged flap in the inner wall of the secondary air flow path, and a connecting rod mechanically interlinking the first and second flaps, the connecting rod being hinged at one of its end to the first flap and at its other end to the second flap.

6 Claims, 2 Drawing Sheets

BLOW-OFF DEVICE FOR A BYPASS GAS TURBINE ENGINE

BACKGROUND OF THE INVENTION

1. Field of the Invention

The invention relates to a blow-off device for a bypass gas turbine engine, such as a bypass turbojet turbine-engine.

2. Discussion of the Prior Art

It is known, for example from U.S. Pat. No. 3,638,428, to fit blow-off members in the wall of the primary air flow path between the low pressure compressor and the high pressure compressor of a gas turbine engine, the blow-off members opening as required, to allow the discharge of air into the secondary air flow path in order to avoid the problem of surging.

These blow-off members comprise a number of flaps which are distributed around the wall of the air flow path and are controlled synchronously. The control mechanism must be able to cause rapid opening and closure of the flaps and to maintain them in the closed position with no leakage of air. Accordingly, the control mechanism is relatively complicated.

As a result of the cumulative effect of play between the various components of the mechanism, the flaps that are furthest away from the actuator which controls their opening and closing are inadequately clamped against their seat and have a tendency to open slightly under the pressure of the air coming from the low pressure compressor. The leakage flow thus caused interferes with the operation of the high pressure compressor. In addition, the flaps have a tendency to flutter, which generates vibrations and, in the long term, causes their deterioration.

FR Patent 2 260 697 discloses a combined pressure boosting and relief mechanism comprising an assembly of booster valves formed by two panels, one for the primary flow and the other for the secondary flow, which are pivoted by a rack and pinion mechanism so that they open simultaneously in opposite directions into their respective flow paths to carry out a pressure boosting function. Each panel comprises a central flap, the two flaps opening symmetrically towards each other away from their respective flow paths to perform a relief function.

In this case also, play in the assembly does not ensure the proper closure of the flaps which effect the pressure relief function and they are therefore liable to open slightly and to flutter. In addition, the pressure in the secondary flow path is applied to the corresponding flaps and tends to open them slightly. Thus, the force applied to the control mechanism must be all the greater.

SUMMARY OF THE INVENTION

It is an aim of the present invention to provide a blow-off device with means which enables the flaps to be maintained in the closed position in a manner which prevents their partial opening and the development of flutter under the pressure of the primary air flow.

To this end, according to the invention there is provided a blow-off device for a gas turbine engine of the bypass type including a primary air flow path, a secondary air flow path disposed outwardly of said primary air flow path, and a partition separating said primary and secondary air flow paths from each other, said blow-off device comprising a plurality of discharge passages passing through said partition from said primary air flow path to said second air flow path, and closure means operable to open and close said discharge passages, said closure means comprising, at each of said discharge passages, a first hinged flap in the outer wall of said primary air flow path, a second hinged flap in the inner wall of said secondary air flow path, and a connecting rod mechanically linking said first and second flaps together, said connecting rod being pivotally connected at one end to said first flap and at its other end to said second flap.

Thus, when the flaps in the wall of the primary air flow path pivot outwards away from the flow path, the connecting rods cause the flaps in the wall of the secondary air flow path to pivot outwards into the secondary flow path.

As a result, when the closure means causes the primary flow path flaps to return to the closed position, the connecting rods also bring the flaps of the secondary flow path into the closed position. The pressure existing in the secondary flow path then exerts on each of the second flaps a force which is transmitted by the respective connecting rod to the corresponding first flap to cause it to stay closed and prevent it from partially opening under the pressure in the primary flow path.

Other features of the invention will become apparent from the following description of a Preferred embodiment with reference to the attached drawings.

DESCRIPTION OF THE PREFERRED EMBODIMENT

Figure 1:
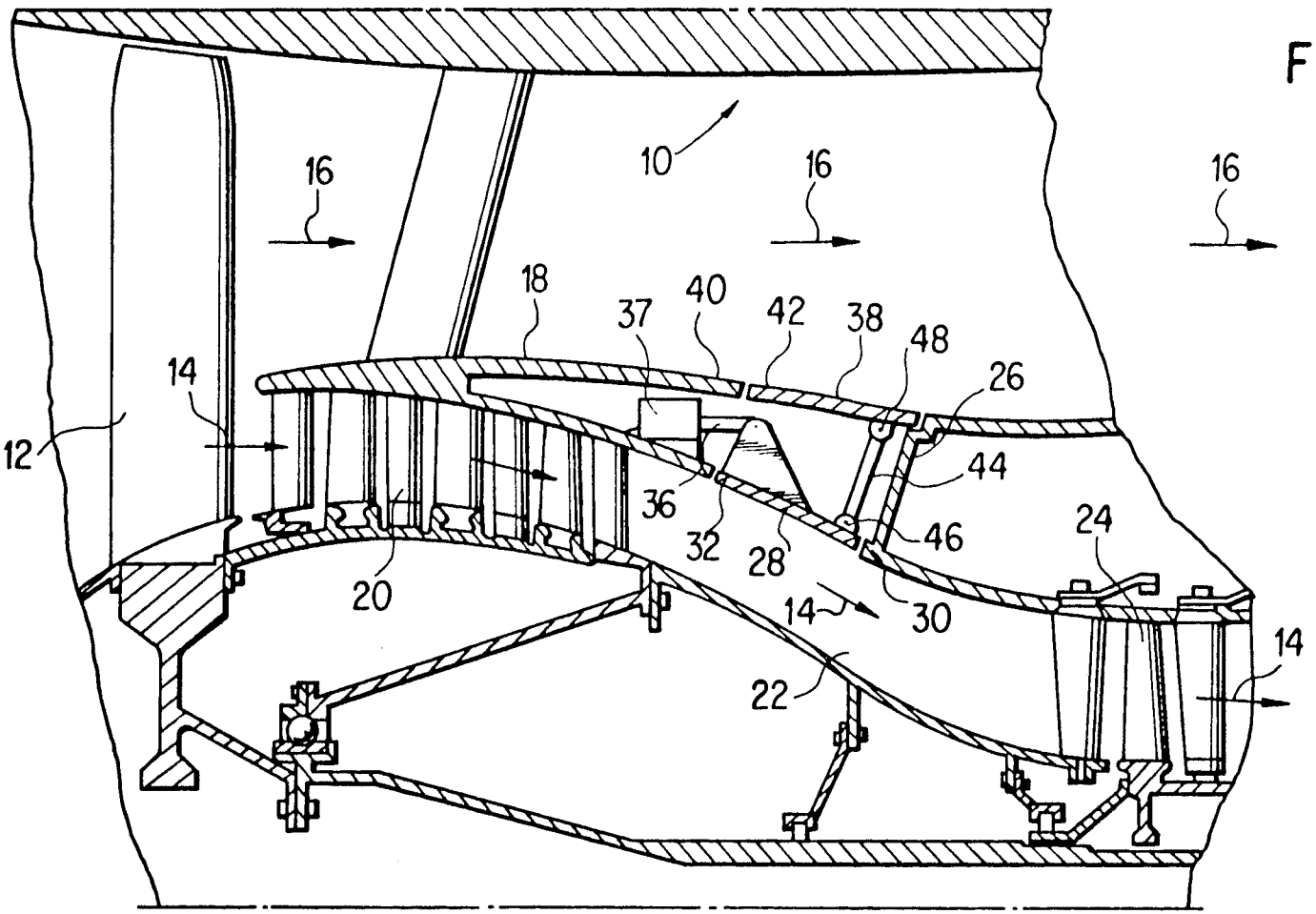
FIG. 1 is a diagrammatic longitudinal section through part of a bypass turbojet engine fitted with one embodiment of the device in accordance with the invention.

FIG. 1 shows a bypass turbojet engine 10 with an axis X—X and including a fan 12 for supplying air to an annular primary air flow path 14 and an annular secondary air flow path 16 separated from each other by an assembly forming a partition 18.

In the primary air flow path 14 there is, in succession, a low pressure compressor 20, an intermediate chamber 22, and a high pressure compressor 24. In order to prevent surging of the low pressure compressor 20 from taking place under certain operating conditions, a blow-off or discharge passage 26 is provided in the partition 18 for discharging a part of the primary airflow from the intermediate chamber 22 into the secondary flow path 16. The blow-off passage 26 is controlled by a plurality of flap assemblies, each comprising two flaps 28 and 38.

The first flap 28 is disposed in the outer wall 30 of the primary air flow path 14 and is hinged about an axis 32 which is substantially at right angles to the axis of the engine as well as to the direction of the primary air flow, the axis 32 being located along the upstream edge of the flap 28, i.e. the edge nearer to the low pressure compressor 20. A lever 34 which is fixed to the first flap 28 protrudes into the interior of the partition 18 and is coupled to a rod 36 of a control mechanism 37 designed to control in synchronism the pivoting of all the flaps 28 arranged around the circumference of the outer wall 30 of the primary flow path 14 so that each flap 28 pivots towards the interior of the partition 18 and hence outwards from the primary flow path to establish communication between the primary flow path and the blow-off passage 26 leading through the partition.

The second flap 38 is disposed in the inner wall 40 of the secondary air flow path 16 and is hinged about an axis 42 which is also substantially at right angles to the axis of the engine and is located along the upstream edge of the second flap 38.

A rod 44 connects the first and second flaps 28,38, being pivotally connected at its opposite ends 46,48 to the facing sides of the two flaps 28,38 respectively.

Figure 2:
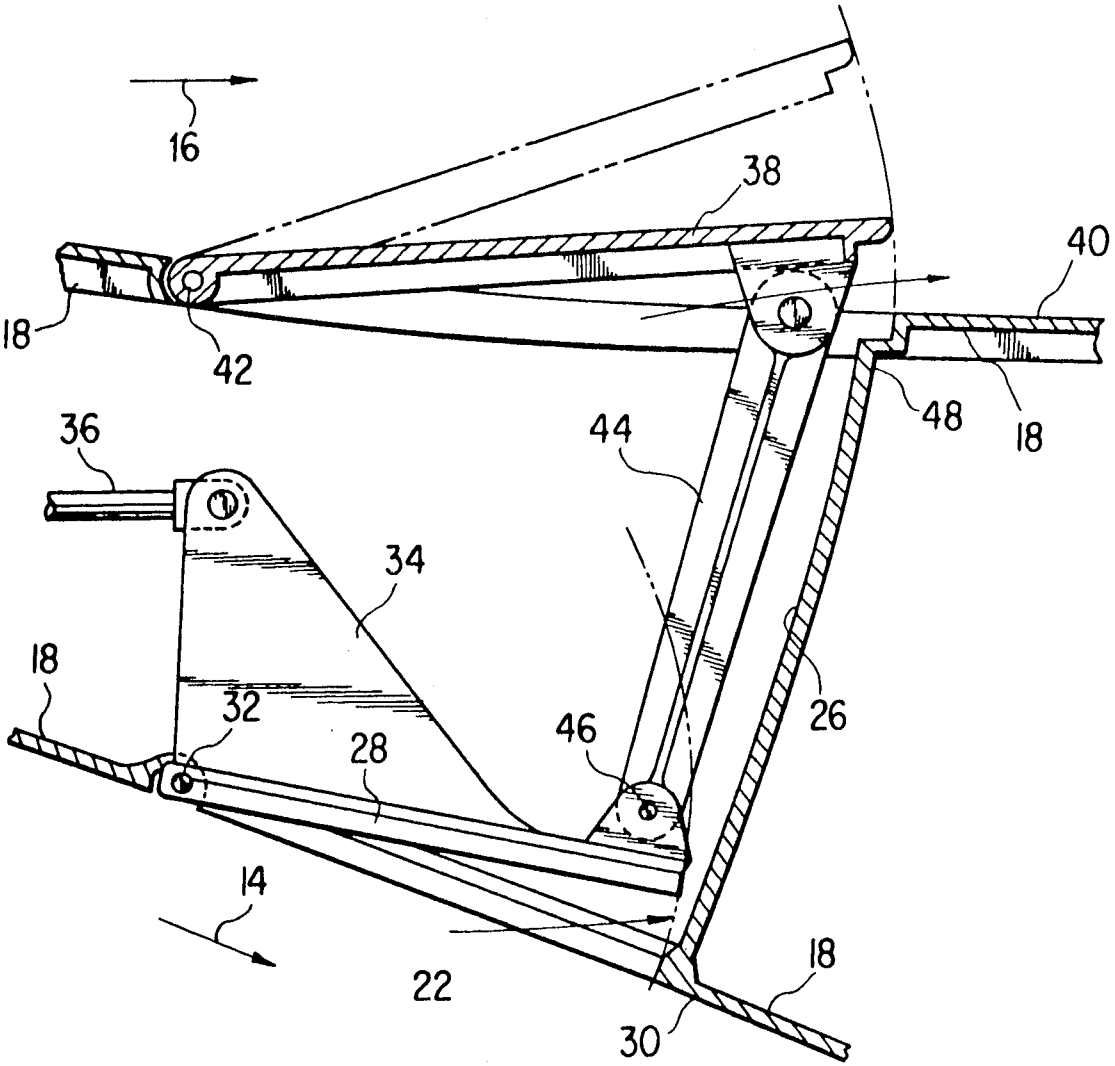
FIG. 2 shows part of the device shown in FIG. 1 in a larger scale.

Thus, as shown in detail in FIG. 2, when the rod 36 of the control mechanism causes the first flap 28 to pivot away from the primary flow path 14, the flap 28 acts on the connecting rod 44 and causes this, in turn, to pivot the second flap 38 into the secondary flow path 16, thus opening the blow-off passage 26 to the secondary flow path.

Conversely, when the control mechanism causes the first flap 28 to pivot back towards the outer wall 30 of the primary flow path 14, the connecting rod 44 also causes the second flap 38 to move back towards the inner wall 40 of the secondary flow path 16, i.e., into the position illustrated in FIG. 1.

In this situation, the pressure of air flowing through the secondary flow path 16 exerts a force on the second flap 38 directed towards the interior of the partition 18, this force being transmitted by the connecting rod 44 to the first flap 28 to assist in maintaining this flap in a fully closed position and preventing it from opening partially and fluttering, even when the flap 28 in question is the furthest removed from the control mechanism 37 and the accumulated play of the components of the mechanism is such that precise control of this flap is no longer possible.

In addition, this force compensates at least partly for the force exerted in the opposite direction on the first flap 28 by the air under pressure in the intermediate chamber 22 downstream of the low pressure compressor 20, thus reducing to some extent the forces the control mechanism 37 has to overcome. It is therefore possible to lighten the mechanism and/or to improve its operation.

As will be clear to the skilled reader, the respective sizes of the two flaps 28,38 may be chosen as desired, as may be the positions of the connection points 46,48 of the connecting rod 44 to the two flaps in relation to their hinge axes 32,42.

In particular, the size of the second flap 38 may be greater than that of the first flap 28 so as to compensate, at least partially, for the difference between the pressure of the secondary airstream 16 and that in the intermediate chamber 22 of the primary flow path 14.

Moreover, the distance between the connection point 48 of the connecting rod 44 to the second flap 38 and the pivot axis 42 of the second flap 38 may be less than the distance between the connection Point 46 of the connecting rod 44 to the first flap 28 and the pivot axis 32 of the first flap 28.

In addition to providing a better balance between the opposing forces that the flaps 28 and 38 exert on the connecting rod 44, this arrangement enables differential opening of the two flaps to be achieved in order to control the flow of air discharged from the primary air flow path 14 into the secondary air flow path 16.

Obviously, numerous modifications and variations of the present invention are possible in light of the above teachings. It is therefore to be understood that within the scope of the appended claims, the invention may be practiced otherwise than as specifically described herein.

What is claimed is:

1. A blow-off device for a gas turbine engine of the bypass type including a primary air flow path, a secondary air flow path disposed outwardly of said primary air flow path, and a partition separating said primary and secondary air flow paths from each other, wherein said blow-off device comprises:

a plurality of discharge passages passing through said partition from said primary air flow path to said secondary air flow path, and closure means operable to open and close said discharge passages, said closure means comprising, at each of said discharge passages, a first hinged flap in the outer wall of said primary air flow path, a second hinged flap in the inner wall of said secondary air flow path, and a connecting rod mechanically linking said first and second flaps together, said connecting rod being pivotally connected at one end to an end portion of said first flap and at its other end to an end portion of said second flap wherein the distance between the connection point of said connecting rod to said first flap and the hinge axis of said first flap is different from the distance between the connection point of said connecting rod to said second flap and the hinge axis of said second flap.

2. A blow-off device in accordance with claim 1, wherein said first and second hinged flaps are each mounted so as to turn about a hinge axis sited along the upstream edge thereof.

3. A blow-off device for a gas turbine engine of the bypass type including a primary air flow path, a secondary air flow path disposed outwardly of said primary air flow path, and a partition separating said primary and secondary air flow paths from each other, wherein said blow-off device comprises:

a plurality of discharge passages passing through said partition from said primary air flow path to said secondary air flow path, and closure means operable to open and close said discharge passages, said closure means comprising, at each of said discharge passages, first hinged flap means in the outer wall of said primary air flow path, second hinged flap means in the inner wall of said secondary air flow path for exerting a closing force on said first flap, and a connecting rod mechanically linking said first and second flaps together, said connecting rod being pivotally connected at one end to said first flap and at its other end to said second flap wherein the distance between the connection point of said connecting rod to said first flap and the hinge axis of said first flap is different from the distance between the connection point of said connecting rod to said second flap and the hinge axis of said second flap.

4. A blow-off device in accordance with claim 3, wherein said first and second hinged flaps are each mounted so as to turn about a hinge axis sited along the upstream edge thereof.

5. A blow-off device for a gas turbine engine of the bypass type including a primary air flow path, a secondary air flow path disposed outwardly of said primary air flow path, and a partition separating said primary and secondary air flow paths from each other, wherein said blow-off device comprises:

a plurality of discharge passages passing through said partition from said primary air flow path to said secondary air flow path, and closure means operable to open and close said discharge passages, said closure means comprising, at each of said discharge passages, first hinged flap means in the outer wall of said primary air flow path, second hinged flap means in the inner wall of said secondary air flow path for exerting a closing force on said first flap, and a connecting rod mechanically linking said first and second flaps together, said connecting rod being pivotally connected at one end to said first flap and at its other end to said second flap wherein said first flap and said second flap are of a different size and said second flap has a greater surface area than said first flap.

6. A blow-off device for a gas turbine engine of the bypass type including a primary air flow path, a secondary air flow path disposed outwardly of said primary air flow path, and a partition separating said primary and secondary air flow path disposed outwardly of said primary air flow path, and a partition separating said primary and secondary air flow paths from each other, wherein said blow-off device comprises:

a plurality of discharge passages passing through said partition from said primary air flow path to said secondary air flow path, and closure means operable to open and close said discharge passages, said closure means comprising, at each of said discharge passages, a first hinged flap in the outer wall of said primary air flow path, a second hinged flap in the inner wall of said secondary air flow path, and a connecting rod mechanically linking said first and second flaps together, said connecting rod being pivotally connected at one end to an end portion of said first flap and at its other end to an end portion of said second flap wherein said first flap and second flap are of a different size and said second flap has a greater surface area than said first flap.

* * * * *